US010260525B2

(12) United States Patent
Her et al.

(10) Patent No.: US 10,260,525 B2
(45) Date of Patent: Apr. 16, 2019

(54) FAN MODULE

(71) Applicant: NANNING FUGUI PRECISION INDUSTRIAL CO., LTD., Nanning (CN)

(72) Inventors: Shyue-Dar Her, New Taipei (TW); Wei-Hsi Chen, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 311 days.

(21) Appl. No.: 15/096,276

(22) Filed: Apr. 12, 2016

(65) Prior Publication Data

US 2017/0184127 A1 Jun. 29, 2017

(30) Foreign Application Priority Data

Dec. 28, 2015 (TW) ..... 104143934 A

(51) Int. Cl.
*F04D 29/60* (2006.01)
*F04D 25/06* (2006.01)

(52) U.S. Cl.
CPC ..... *F04D 29/601* (2013.01); *F04D 25/0613* (2013.01)

(58) Field of Classification Search
CPC ..... F04D 29/601; F04D 25/0613
USPC ..... 415/213.1
See application file for complete search history.

(56) References Cited

U.S. PATENT DOCUMENTS 5,208,730 A * 5/1993 Tracy ..... F04D 29/668 361/679.48
6,556,437 B1 * 4/2003 Hardin ..... H05K 7/20172 361/679.48
6,592,327 B2 * 7/2003 Chen ..... F04D 25/166 415/213.1
6,826,048 B1 11/2004 Dean et al.
7,301,768 B2 11/2007 Fan et al.
7,379,300 B1 * 5/2008 Chen ..... H05K 7/20172 165/122
7,492,590 B2 2/2009 Chen et al.
8,373,989 B2 * 2/2013 Gong ..... H05K 7/20172 165/104.33
8,939,723 B2 * 1/2015 Kuo ..... H05K 7/20172 415/119
2009/0257192 A1 * 10/2009 Li ..... F04D 25/0613 361/695
2012/0125565 A1 * 5/2012 Zhang ..... H05K 7/20172 165/67

(Continued)

FOREIGN PATENT DOCUMENTS

CN 2680908 Y 2/2005
CN 101083894 A 12/2007
CN 201092980 Y 7/2008

(Continued)

*Primary Examiner* — Timothy L Maust
(74) *Attorney, Agent, or Firm* — ScienBiziP, P.C.

(57) ABSTRACT

A fan module comprises a fan and a positioning frame cooperated with the fan. The fan comprising a fixing frame and a main body received in the fixing frame. The fixing frame forms a plurality of fixing columns, the positioning frame forms a plurality of fixing holes correspondingly to the fixing columns. The fixing columns are through the correspondingly fixing holes to fix the fan in the positioning frame.

10 Claims, 4 Drawing Sheets

(56) References Cited

U.S. PATENT DOCUMENTS

| | | | | |
|---|---|---|---|---|
| 2013/0170896 | A1 | 7/2013 | Pang et al. | |
| 2013/0315728 | A1* | 11/2013 | Zhou | G06F 1/183 415/213.1 |

FOREIGN PATENT DOCUMENTS

| | | | |
|---|---|---|---|
| CN | 201563339 | U | 8/2010 |
| CN | 102467205 | A | 5/2012 |
| CN | 103149989 | A | 6/2013 |
| CN | 103294133 | A | 9/2013 |

* cited by examiner

FAN MODULE

CROSS-REFERENCE TO RELATED APPLICATIONS

This application claims priority to Chinese Patent Application No. 104143934 filed on Dec. 28, 2015, the contents of which are incorporated by reference herein.

FIELD

The subject matter herein generally relates to a heat dissipation equipment, for example, a fan module.

BACKGROUND

A fan generally attaches to the case of the electronic equipment by screws. The fan is coupled with the case usually by screws. The location of the fan and the mounts of the fan are hard to change. When the fan needs to be removed or the fan needs to be changed to be mounted at a different location, different tools to be employed.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

Figure 1:
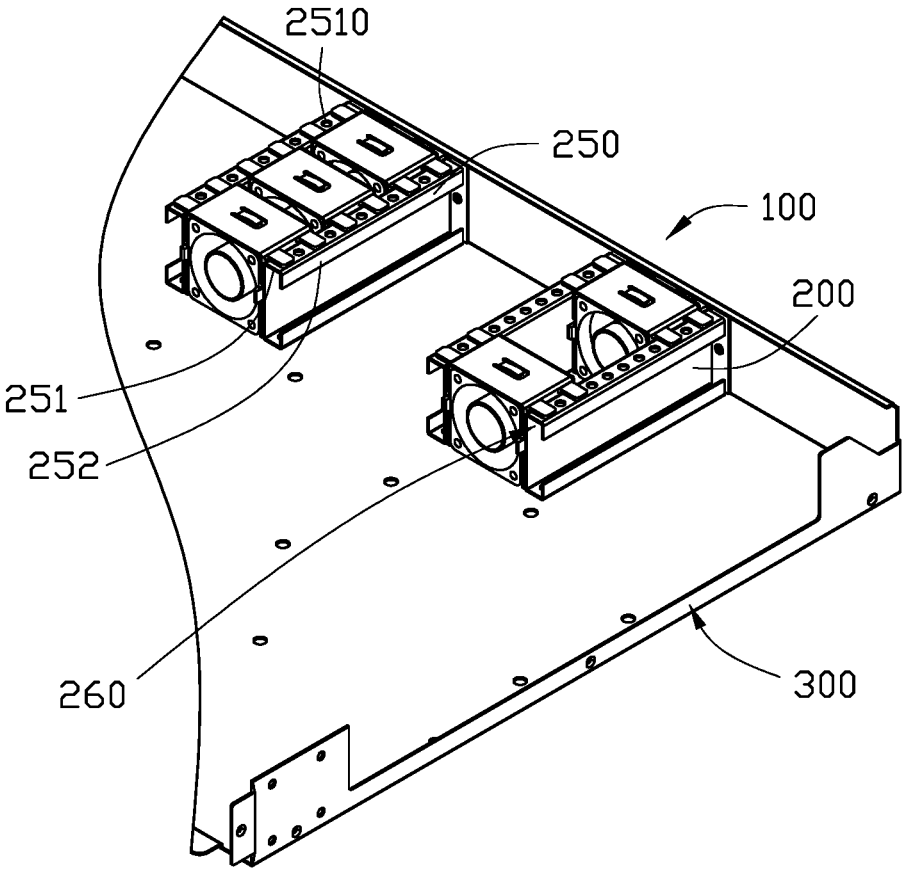
FIG. 1 is an assembled view of a fan module of the present disclosure.

As illustrated in FIG. 1, a fan module of the present disclosure includes a fan 100 and multiple positioning frames 200 assembled with the fan 100. The fan module is mounted on a case 300 of electronic equipment to dissipate heat generated from the case.

Figure 2:
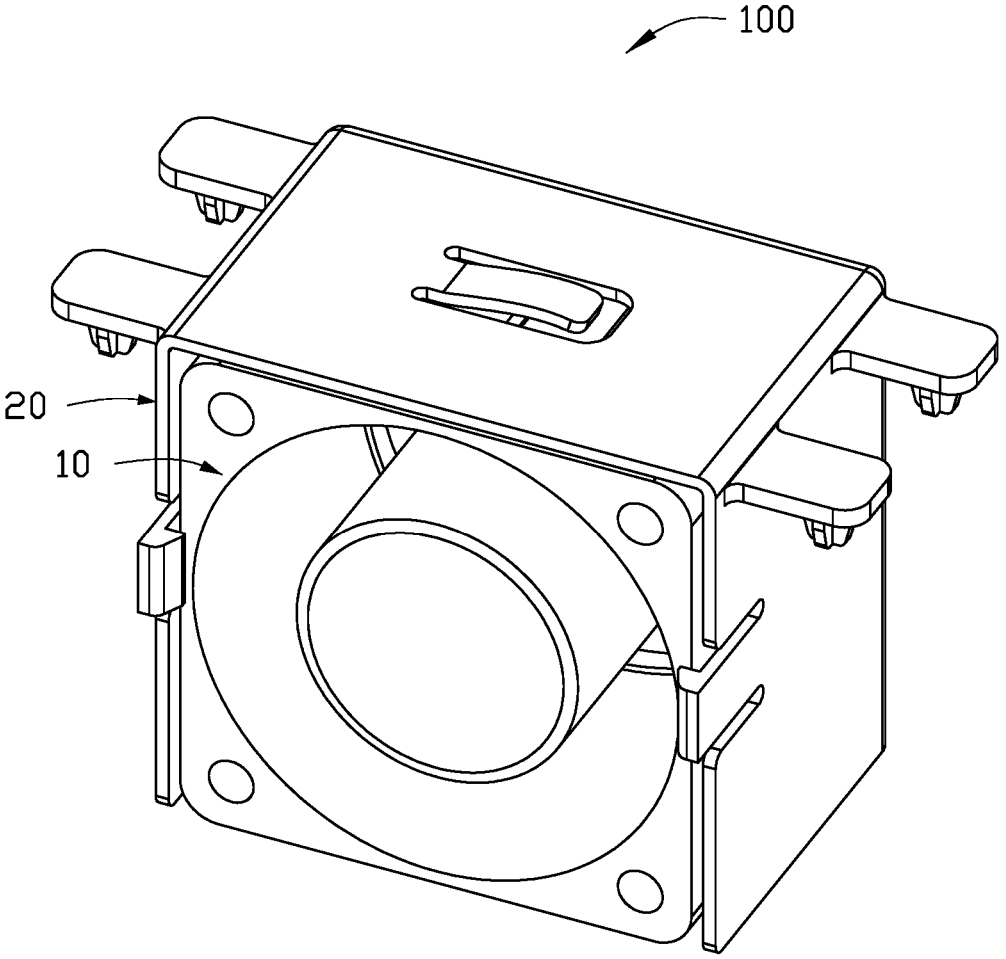
FIG. 2 is an assembled view of a fan of the fan module of FIG. 1.
Figure 3:
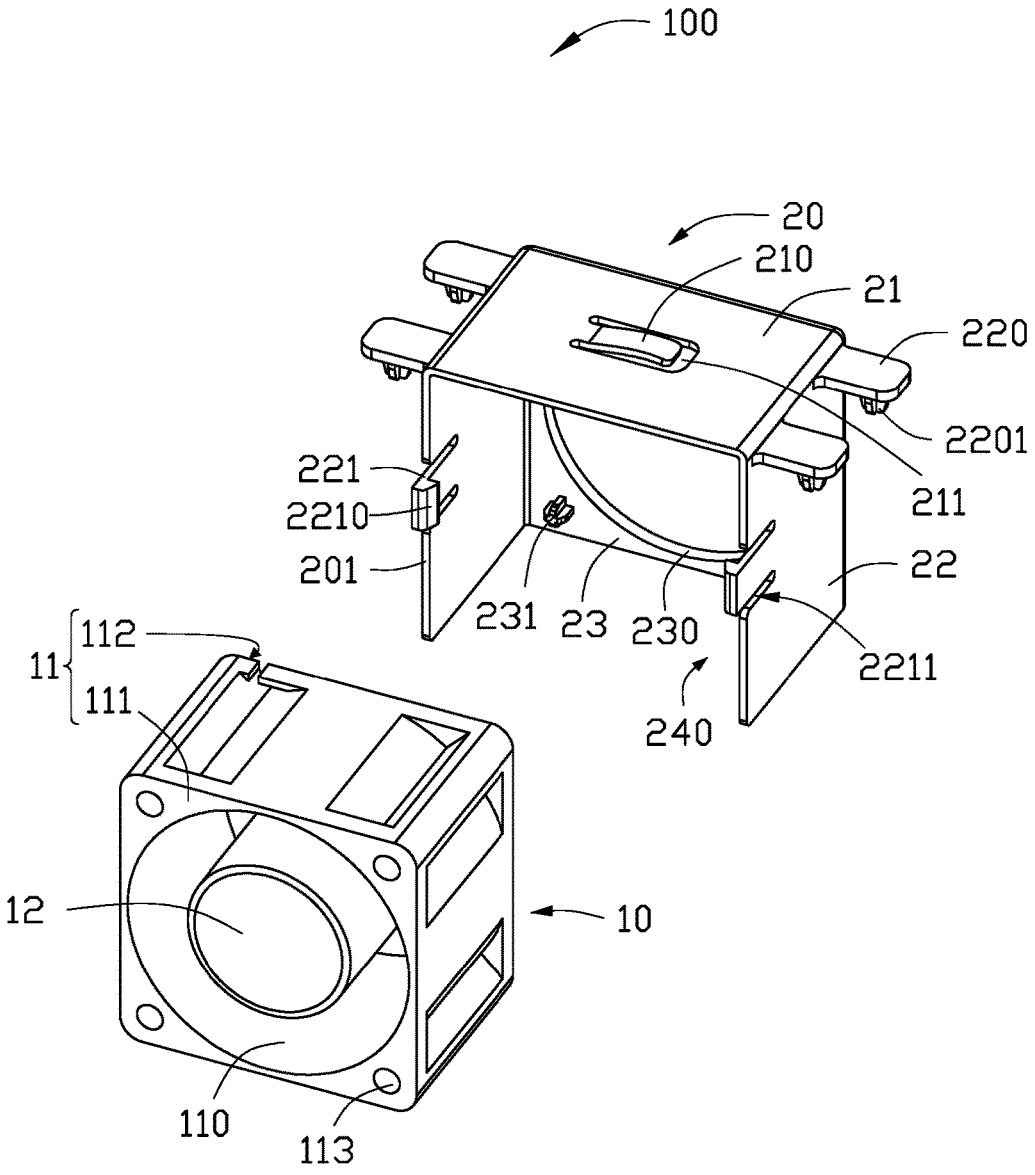
FIG. 3 is an exploded view of the fan module of FIG. 2.
Figure 4:
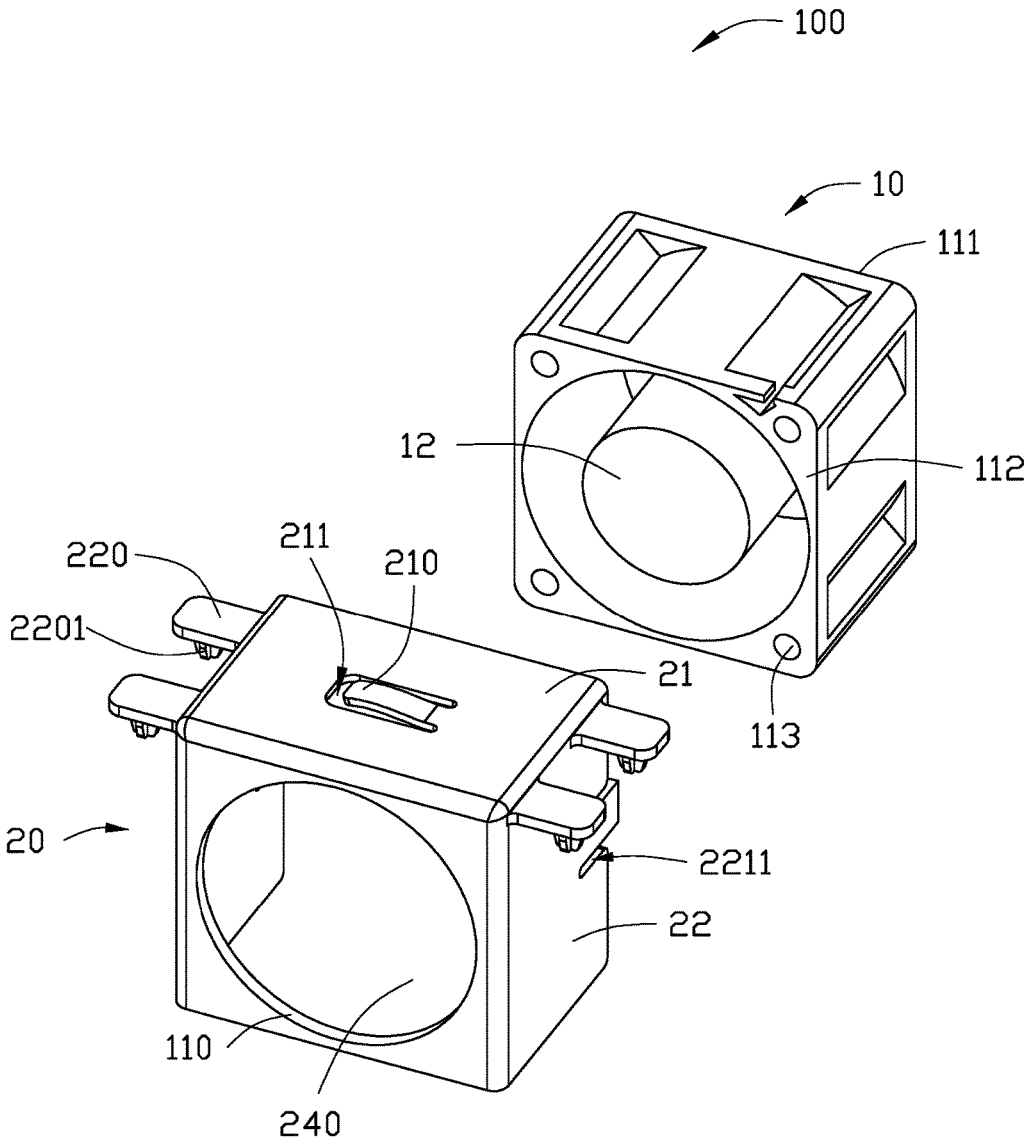
FIG. 4 is an exploded view of the fan module of FIG. 2, but shown from another aspect.

Also as illustrated in FIGS. 2-4, the fan 100 includes a main body 10 and a fixing frame 20. The main body 10 includes a frame 11 and a wheel hub 12. The frame 11 is rectangular and has front surface 111 and a rear surface 112 opposite to the front surface 111. The frame 11 defines a cavity 110 extending through the front surface 111 and the rear surface 112. The first cavity 110 is circular to receive the wheel hub 12 therein. The frame 11 also defines a plurality of through holes 113 extending through the front surface 111 and the rear surface 112. The through holes 113 are configured on a corner position of the front surface 111 and the rear surface 112 to surrounds the first cavity 110.

The main body 10 is fixed inside the fixing frame 20. The fixing frame 20 includes a top surface 21, two sidewalls 22 extending from two ends of the top surface 21, and a retaining wall 23 extending from the top surface 21 and connecting the sidewalls 22. The top surface 21, the sidewall 22 and the retaining wall 23 collectively define an second cavity 240. The main body 10 is received in the second cavity 240 through its open portion 201.

A center of the top surface 21 forms a sheet 210. An end of the sheet 210 connects to the top surface 21 and another end is a free end and beyond the top surface 21. Two sides of the sheet 210 and the free end of the sheet 210 are spaced from the top surface 21 to define a gap 211 therebetween.

Each of the sidewalls 22 extends perpendicularly from an end to form a plurality of tabs 220. A top of the tabs 220 is parallel to a top of the top surface 21. Fixing columns 2201 extends perpendicularly downward from a bottom of the tabs 220 for fixing the fan 100 on the positioning frame 200. Each sidewall 22 includes a buckle 221. Two buckles 221 correspond in position relative to each other at the fronts of the sidewall 22. An end of the buckle 221 connects to the sidewall 22 and another end of the buckle 221 forms an extension part 2210. Sides of the buckle 221 are spaced from the sidewall 22 to define two gaps 2211.

The retaining wall 23 has a hole 230 corresponding to the first cavity 110 of the main body 10. While the main body 10 is received in the fixing frame 20, a surface of the wheel hub 12 is exposed out of the hole 230. A plurality of positioning columns 231 are formed on the retaining wall 23 towards inside the second cavity 240. The positioning columns 231 are located around a periphery of the hole 230 to correspond to the through holes 113 of the main body 10. The positioning columns 231 can be inserted into the through holes 113 to receive the main body 10 in the second cavity 240 of the fixing frame 20.

As illustrated in FIG. 1, each of the positioning frames 200 is configured as plate shaped and parallel to each other. Two sides of each positioning frame 200 extend along a same direction to form a pair of edgefolds 250. Each edgefold 250 includes a first extending portion 251 and a second extending portion 252 perpendicularly to the first extending portion 251. The second extending portion 252 is parallel to and spaced from the positioning frame 200. The first extending portion 251 is perpendicular to the positioning frame 200, and the second extending portion 252 extends from a distal end of the first extending portion 251 and is perpendicular to the first extending portion 251. The first extending portion 251, the second extending portion 252 and the positioning frame 200 collectively define a U-shaped groove 260. The first extending portion 251 also defines a plurality of fixing holes 2510. The fixing holes 2510 are correspondingly to the fixing columns 2201 to fix the fan 100 on the positioning frame 200.

The fan module can be assembled by following steps: firstly, the main body 10 is received in the second cavity 240 of the fixing frame 20, the positioning columns 231 are inserted into the through hole 1113 of the main body 10 to configure the main body 10 in the second cavity 240, the extension part 2210 of the buckle 221 is attached to the leading edges of the front surface 111 of the frame 11, thus the main body 10 is fixed in the second cavity 240 of the positioning frame 20 to assemble the fan 100. Secondly, the fan 100 is fixed on the positioning frame 200, the fixing columns 2201 of the fan 100 are correspondingly penetrated through the fixing through 2510 (showed in FIG. 1) of the positioning frame 200, thus the fan module is assembled completely.

In the present disclosure, the main body 10 and the fixing frame 20 is assembled together by extending portions 221 and the positioning columns 231. Thus, the main body 10 and the fixing frame 20 is convenient to assemble and dismount. Further, the fan 100 is fixed on the positioning frame 200 by the fixing columns 2201 and the correspondingly fixing through holes 2510. Thus, multiple fans 100 can be fixed on the positioning frame 200, and each fan can be fixed on any one of the through holes 2510. Therefore, the number of the fan can be adjusted depends on a demand.

The embodiments shown and described above are only examples. Many details are often found in the art such as the other features of a fan module. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A fan module comprising:

a fan and two positioning frame cooperating with the fan;

the fan comprising a fixing frame and a main body received in the fixing frame;

the fixing frame forming a plurality of fixing columns, the positioning frames defining a plurality of fixing holes correspondingly to the fixing columns;

the fixing columns penetrating through the correspondingly fixing holes to fix the fan on the positioning frames;

wherein the fixing frame comprises a top surface, two sidewalls extending from two ends of the too surface and a retaining wall extending from the too surface and connecting the sidewalls, and the top surface, the two sidewalls and the retaining wall collectively defining a cavity;

wherein the fixing frame further comprises a plurality of tabs extending perpendicularly therefrom, and the fixing columns extending from a side of the tabs.

2. The fan module of claim 1, the further comprising a buckle, wherein one end of the buckle connects to one of the sidewalls, and another end of the buckle forms an extending portion for fixing the main body in the cavity.

3. The fan module of claim 2, wherein two sides of the buckle are spaced from the sidewall of the fixing frame to define a gap.

4. The fan module of claim 1, wherein a center of the top surface forms a sheet, an end of the sheet connects the top surface and another end is a free end beyond the top surface.

5. The fan module of claim 1, wherein the main body comprises a frame, the frame has a front surface and a rear surface opposite to the front surface, the frame define another cavity, the another cavity extends through the front surface and the rear surface.

6. The fan module of claim 2, wherein the retaining wall is located on a side of the cavity, and a positioning column is formed on the retaining wall and extends toward the cavity, wherein a through hole is configured on a corner position of the main body, and the positioning column is inserted into the through hole.

7. The fan module of claim 6, wherein the position column passes through the through hole to receive the main body in the cavity, and the extending portion of the buckle attaches to a front surface of the frame.

8. The fan module of claim 1, wherein the two positioning frames each has a plate shape and are arranged parallel to each other, and each of the positioning frames comprises an edgefold extending in a direction that is away from the other positioning frame, wherein the fixing holes are located on the edgefolds.

9. The fan module of claim 8, wherein each edgefold comprises a first extending portion perpendicularly to the positioning frame and a second extending portion perpendicularly to the first extending portion, the second extending portion is parallel to and spaced from the positioning frame.

10. The fan module of claim 9, wherein the first extending portion, the second extending portion and the positioning frame collectively define a U-shaped groove.

* * * * *